US008980363B2

(12) United States Patent
Grenier et al.

(10) Patent No.: US 8,980,363 B2
(45) Date of Patent: Mar. 17, 2015

(54) METHOD AND APPARATUS FOR PRODUCING A CENTRED COMPRESSION COATED TABLET

(75) Inventors: Pascal Grenier, Kappelen (FR); Guy Vergnault, Kembs (FR)

(73) Assignee: Jagotec AG, Muttenz (CH)

( * ) Notice: Subject to any disclaimer, the term of this patent is extended or adjusted under 35 U.S.C. 154(b) by 1465 days.

(21) Appl. No.: 12/527,266

(22) PCT Filed: Feb. 15, 2008

(86) PCT No.: PCT/IB2008/000648

§ 371 (c)(1),
(2), (4) Date: Sep. 30, 2010

(87) PCT Pub. No.: WO2008/099283

PCT Pub. Date: Aug. 21, 2008

(65) Prior Publication Data

US 2011/0014352 A1 Jan. 20, 2011

(30) Foreign Application Priority Data

Feb. 15, 2007 (GB) ..... 0702974.7

(51) Int. Cl.
*B05D 3/12* (2006.01)
*B05C 9/00* (2006.01)
*B30B 11/34* (2006.01)

(52) U.S. Cl.
CPC ..... *B30B 11/34* (2013.01)
USPC ..... 427/2.14; 118/100

(58) Field of Classification Search
CPC ..... B03B 11/34; B05D 3/12; B05C 9/00
USPC ..... 427/2.14; 118/100
See application file for complete search history.

(56) References Cited

U.S. PATENT DOCUMENTS

| | | | | | |
|---|---|---|---|---|---|
| 568,488 | A | * | 9/1896 | Noyes | 425/120 |
| 2,700,938 | A | * | 2/1955 | Wolff et al. | 264/275 |
| 2,849,965 | A | * | 9/1958 | Stott | 425/112 |
| 2,946,298 | A | * | 7/1960 | Doepel et al. | 264/275 |
| 3,000,331 | A | * | 9/1961 | Frank | 425/126.1 |
| 3,096,248 | A | * | 7/1963 | Rudzki | 264/112 |
| 4,259,049 | A | | 3/1981 | Willich | |
| 5,088,915 | A | * | 2/1992 | Korsch et al. | 425/345 |
| 5,654,005 | A | * | 8/1997 | Chen et al. | 424/480 |

(Continued)

FOREIGN PATENT DOCUMENTS

| | | |
|---|---|---|
| EP | 1302304 | 4/2003 |
| EP | 1386722 | 2/2004 |

(Continued)

OTHER PUBLICATIONS

International Search Report for PCT/IB2008/000648, mailed Jul. 28, 2008.

(Continued)

*Primary Examiner* — Dah-Wei D Yuan
*Assistant Examiner* — Hai Yan Zhang
(74) *Attorney, Agent, or Firm* — Muriel Liberto, Esq.; Mintz Levin Cohn Ferris Glovsky and Popeo, P.C.

(57) ABSTRACT

The present invention provides a method and apparatus for positioning the core of the compression coated tablet in manufacturing techniques for the production of such tablets.

6 Claims, 4 Drawing Sheets

(56) References Cited

U.S. PATENT DOCUMENTS

Figure 1:
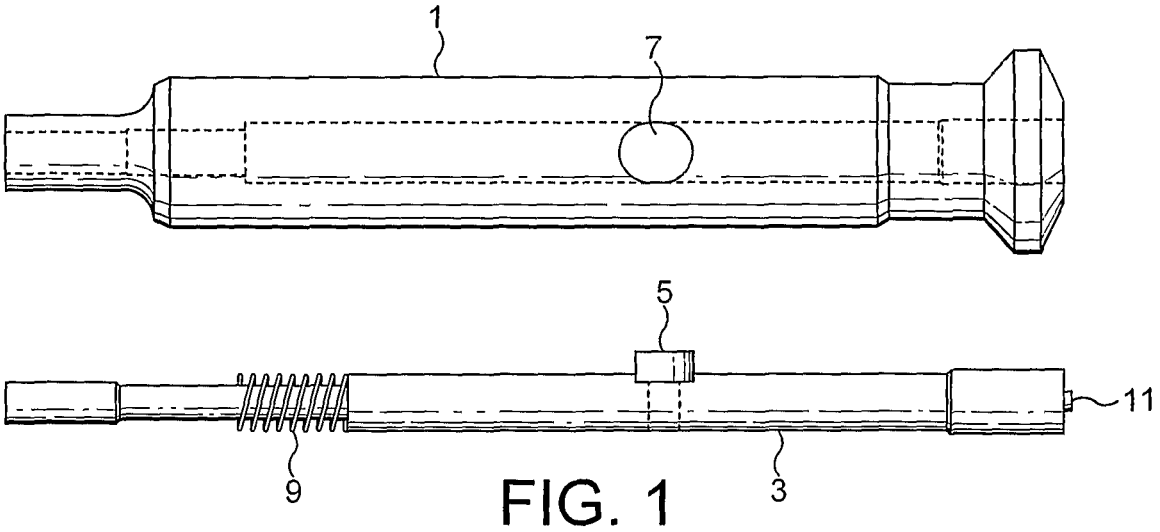

| | | | | |
|---|---|---|---|---|
| 6,004,943 | A * | 12/1999 | Shi et al. | 514/44 R |
| 6,689,305 | B1 * | 2/2004 | Fernholz et al. | 264/414 |
| 2003/0091625 | A1 * | 5/2003 | Hariharan et al. | 424/465 |
| 2003/0160353 | A1 | 8/2003 | Robinson et al. | |
| 2003/0206954 | A1 * | 11/2003 | Lerner et al. | 424/471 |
| 2004/0067868 | A1 | 4/2004 | Wiedemann et al. | |
| 2005/0019407 | A1 * | 1/2005 | Sowden et al. | 424/472 |
| 2005/0031665 | A1 * | 2/2005 | Watson et al. | 424/423 |
| 2006/0105040 | A1 * | 5/2006 | Waterman | 424/472 |
| 2006/0233880 | A1 * | 10/2006 | Lerner et al. | 424/469 |
| 2008/0255510 | A1 * | 10/2008 | Wang | 604/103.02 |
| 2010/0136180 | A1 * | 6/2010 | Heald et al. | 426/89 |
| 2011/0256555 | A1 * | 10/2011 | Yu et al. | 435/7.21 |

FOREIGN PATENT DOCUMENTS

| | | |
|---|---|---|
| GB | 743222 | 1/1956 |
| GB | 818217 | 8/1959 |
| GB | 839502 | 6/1960 |
| GB | 1034713 | 6/1966 |

OTHER PUBLICATIONS

Search Report for GB0410137.4, mailed Sep. 29, 2004.

* cited by examiner

METHOD AND APPARATUS FOR PRODUCING A CENTRED COMPRESSION COATED TABLET

RELATED APPLICATIONS

This application is a national stage application, filed under 35 U.S.C. §371, of International Application No. PCT/IB2008/000648, filed on Feb. 15, 2008 which claims the benefit of GB 0702974.7 filed Feb. 15, 2007, the contents of which are incorporated by reference in their entireties.

The invention relates to the manufacturing of compression coated tablets. In particular, the invention relates to a method and apparatus for improving the centring of the core of a compression coated tablet.

Pharmaceutical tablets are a convenient, easy and relatively cheap way of administering an accurate pharmaceutical dose in oral form.

Conventional tablets are designed to deliver their content immediately after being swallowed. However for many drugs, a different drug release profile is required for therapeutical efficacy or better patient compliance. Conventional tablets may not be able to solve problems with drug incompatibility.

Various technologies have been developed to answer to these problems, for example film coated tablets, multilayer tablets or compression coated tablets.

Compression coated tablets are manufactured by compression of a tablet within a tablet so that the outer coat becomes a coating. As many as two different coats can be compressed around a core tablet. Compression coated tablets may also be known as "press coated" tablets or "dry coated" tablets. As multilayer tablets, compression coated tablets can be used to separate incompatible drugs. They can also be used for modified release formulation.

The development of tablet presses to manufacture compression coated tablets is almost as old as the development of tablet presses for conventional tablets.

An early patent relating to the manufacture of compression coated tablets is U.S. Pat. No. 568,488 which granted in 1886. The essential features of this invention are a mould box or a cavity for receiving the charges of coating material and the pill or tablet with a mould member or die forming its bottom. The supply of coating material and feeding of pills to the mould cavity is automatically regulated. The coating material is fed by a hopper and the pill is fed via an included chute and a check finger which moves intermittently to permit the escape of the pills singly. The machine described in this patent could make only the press coating of pre-formed cores (pills/tablets). An improvement of this technology could be found in U.S. Pat. No. 582,794 that describes a machine combining a mechanism for forming the tablet prior to automatically applying a coating. The whole process can be accomplished in one operation. The machine is equipped with a transferring mechanism which rotates at the same speed to a forming and a coating disk and is located at a point intermediate of their axis. The overlapping of the transferring mechanism with the forming and the coating disk allow the upward transfer of the compressed tablet into the chamber of the transfer device and then their ejection downwards into the coating moulds.

The next advance occurred in 1917 with U.S. Pat. No. 1,248,571 that described a machine having a core feeding system based on a toothed disk. Cores are prepared separately and transferred by the feeding disk into the dices. Synchronisation of the feeding disk is controlled by a starwheel which is actuated in turn by projections on the turret.

In a process for the rapid coating of tablets by compression, U.S. Pat. Nos. 2,700,938 and 2,727,473 (Wolf) identified two major problems to be solved; the first one being the exact centring of the core within the die in which it is to be coated and secondly the immediate removal of the core from whatever transfer means is used to carry it to the die without disturbing the positioning of the core within the die. Accurate positioning of the core in the final press coated tablets could be a critical parameter for efficacy of the drug delivery system. Wolf's patents report a rapid withdraw of the bottom punch after core deposition in order to avoid any further contact of the feeding disk with the core and therefore off centring of the core. A further improvement for the deposition of the core is a feed support plate element which is a thin arcuate shaped like member which allows the core to slide or drop slightly from the support plate element onto the bottom fill.

U.S. Pat. No. 2,849,965 (Stott) describes a machine for manufacturing press coated tablets in which the transfer and the deposition of the core is done with a telescopic or contractile transfer arm. The transfer mechanism has a cavity in which the core tablet can fit closely to enable the core to be transferred to its correct position on the bottom fill. The system is also equipped with a slidable weight which is used to release the tablet and to apply a slight pressure to the core to prevent it from being lifted out of its settled position.

U.S. Pat. No. 3,000,331 addressed the problem occurring in prior art machines whereby the cores are delivered to the dies by feeding systems disposed about the periphery of a wheel that partially overlaps the upper surface of the turntable. There is only one possible point of perfect alignment of the cores with the dies therefore an accurate coordination of the rotation of the feeding disk and the turntable is mandatory. U.S. Pat. No. 3,000,331 describes a system where the core is delivered to each die by moving the tablet along an arc portion of the path of the dices in vertical alignment with the die cavity and pushing down the core while it is being deposited. The deposition along the arc allows a smooth transfer and accurate positioning of the core for the feeding system into the tablet die.

In the last few years, a lot of work has been done by Korsch Company in the field of compression coating. U.S. Pat. No. 5,088,915, describes a core transfer system equipped with sliding arms having one transfer head, each of which are guided by a grooved cam. The grooved cam of the feeding disk has a specific curved shape which allows accurate overlapping of the transfer head and dies over an arc portion of the path of the dices. This approach allows for better core positioning because the perfect alignment of the transfer head/die is not limited to a single point. The upper punch of the invention can be used to push down the core out of the transfer head and press it slightly in the bottom fill in order to secure the positioning of this latter.

A further improvement is described in U.S. Pat. No. 5,256,046. The radial arms are inwardly and outwardly movably supported in the turntable rotor and the core receiving pockets are arranged on a partial circle of the die table. Therefore, a simple movement of the radial arms over the die table transfers the cores from the receiving pockets into the dies and a separate transfer device is not required. The design of such a machine guarantees mechanically a perfect alignment of the transfer head with the dies over a long arc portion of the path of the dices. Other features previously described, like using the upper punch for pushing down the core onto the bottom fill and pressing it slightly to secure its position are also implemented on this tablet press.

U.S. Pat. No. 4,569,650 reports a machine having an inbuilt suction device for ram punches used for the manufacturing of annular tablets, to remove dust from the apparatus. Punches used for manufacturing of annular tablets consist of a stationary ram and a movable ram which move up during filling of the die with powder and remains in place during the compression step in order to give to the tablet a ring shape (or donut shape). The granular powder can get in between the surfaces moving relatively to one another on the stationary ram and movable ram. This could lead rapidly to blocking of the system unless they are cleaned in due time. The suction device described in this invention aims to prevent accumulation of powder in the hollow of the ram punches and allow continuous production of donut shaped tablets.

M. Hariharan & V. K. Gupta "A novel concept for the production of compression-coated tablets" Pharmaceutical Technology Europe April 2002 page 46-56 describes a punch system for forming a compression coated tablet which does not require separate formation of a core tablet or a transfer mechanism for transferring the cores into a layer of coating material. This document describes forming the core of the tablet by adding the core blend to in its granular form to the coating material and then compressing the material to form a tablet.

There is a need for an improved tooling capable of increasing the accuracy of the positioning of the core of compression coated tablets. There is also a need for a means to avoid movement of the core due to the operation of centrifugal forces on high speed tablet machines from its central position after it has been deposited.

The present invention provides an improvement of the centring of the core in compression coated tablets. The invention is a tooling, which can be used with limited modifications of the machine on any tablet press designed for compression coating. The invention aims to maintain the core in a centred position after its deposition on the bottom fill and limit therefore the effect of the centrifugal force that can be noticed on high speed presses. The efficacy of the invention for core centring is independent of the core feeding system used.

According to a first aspect of the invention there is provided a method of producing a compression coated tablet, the method comprising the steps of:

(a) filling a die with a first powdered material;

(b) contacting the powdered material in the die with a shaped punch assembly and applying pressure to the punch to create an imprint in the powdered material, in which the punch comprises a housing adapted to receive a pin which is movable within the housing, the pin having a protruding element at one end for engagement with a means for applying pressure to the pin and punch housing, the pin being provided with a torsion means for engagement with the housing, in which the punch has a brake means for retarding movement of the pin in the housing; wherein the pin is held in a first position by the brake means to engage the protruding element of the pin with the means for applying pressure, to cause movement of the pin within the housing into the powdered material to create the imprint in the powdered material (c) depositing a tablet core in the imprint created in the powdered material to form a partly coated compression coated tablet; and optionally (d) introducing a second powdered material into the die on to the upper surface of the partly coated compression coated tablet; and (e) contacting the second powdered material with the punch and applying pressure to the punch to form a fully coated compression coated tablet, wherein the pin is held in the second position in the housing by the brake means and the means for applying pressure is adapted so as to engage with the housing of the punch only and not to engage with the pin.

Compression coated tablets comprise a core containing an active agent in association with one or more support and/or barrier layers. Such tablets may form multi-layer tablets in which the core is surrounded by two or more layers. The arrangement and orientation of layers can be selected as necessary.

The compression coated tablets may have an overall substantially circular cross-section, or may adopt a more oval cross-section or any other suitable geometric shape, for example rectilinear. The tablet may also be shaped as a caplet (capsule form tablet).

In some tablet configurations, the barrier layer may also contain an active substance such that it acts as a barrier layer with respect to a first active substance containing layer, but which itself is an active substance containing layer. Generally, in such embodiments, the active substance in the active layers is different in the separate layers, although arrangements in which the same active substance is present in the separate active layers in different amounts can also be envisaged.

Any pharmaceutically active substance suitable for oral administration in the form of a tablet can be formulated in a tablet of the present invention. An active substance is therefore a pharmaceutical (drug) with a therapeutic use. Such substances also include those for administration for non-therapeutic uses, such as diagnosis or for dietary purposes.

Preferably the active substance may be one aimed at the treatment of chronic diseases, for example, drugs acting on the cardiovascular system, anti-arrhythmics, cardiac stimulants, vasodilators, calcium antagonists, anti-hypertensives, for example anti-adrenergic substances of central and peripheral action or substances acting on the arteriolar musculature, analgesic substances, substances acting on the renin-angiotensin system, anti-hypertensives and diuretics in association, anti-Parkinson's Disease agents, diuretics and drugs for the treatment of Alzheimer's disease, anti-histamines and/or anti-asthmatics.

Powders can be produced by any of the known techniques such as milling, micronisation, granulation or comminution. The first powdered material may be a granular composition of an active agent and one or more pharmaceutically acceptable excipients and/or diluents. Suitable excipients and diluents are well known in the art and include materials for controlled release (sustained and/or delayed release) and immediate release of active agent from the tablet.

Where the powdered material is prepared for formulation of a controlled release granulate, the material may comprise one or more natural or synthetic hydrophilic polymeric substances, which are biocompatible and/or biodegradable materials and pharmaceutically acceptable, e.g. polyvinylpyrrolidone in particular non-cross-linked polyvinylpyrrolidone (e.g. of molecular weight 30,000-400,000), hydroxypropylcellulose with a molecular weight of from 100,000 to 4,000,000, sodium carboxymethylcellulose (e.g. non-cross-linked, e.g. typical molecular weight 90,000-700,000), carboxymethylstarch, potassium methacrylate-divinylbenzene copolymer, hydroxypropylmethylcellulose with a molecular weight of between 2,000 and 4,000,000, polyethyleneglycols of different molecular weight preferably between 200 and 15,000 (more preferably 1000-15000) and polyoxyethylenes of molecular weight up to 20,000,000 (more preferably 400,000-7,000,000), carboxyvinylpolymers, poloxamers (polyoxyethylene-polyoxypropylene copolymer), polyvinylalcohols, glucanes (glucans), carrageenans, scleroglucanes (scleroglucans), mannans, galactomannans, gellans, xanthans, alginic acid and derivatives (e.g. sodium or calcium alginate, propylene glycol alginate), polyaminoacids (e.g. gelatin), methyl vinyl ether/maleic anhydride copolymer, carboxymethylcellulose and derivatives (e.g. calcium carboxymethylcellulose), ethylcellulose, methylcellulose, starch and starch derivatives, alpha, beta or gamma cyclodextrin, and dextrin derivatives (e.g. dextrin) in general. The hydrophilic polymeric substance is therefore one which can be described as a controlled release polymer or a polymeric substance which is capable of achieving controlled release (CR).

A die according to the invention suitably comprises a cavity in which a tablet can be formed. The die may be filled with a layer of the first powdered material in which an imprint is then created by the action of the shaped punch assembly. Following creation of the imprint, the die is further filled with the second powdered material which is compressed to form the final tablet.

The second powdered material can be identical or different to the first powdered material. Optionally, such a further layer of powdered material may be added to the contents of the die, followed by further compression steps to create a multi-layer tablet.

The powder can suitably be contacted by the shaped punch assembly by lowering the punch assembly until it touches the surface of the powder in the die.

Suitably, the shaped punch assembly is round in cross section. However, the cross section of the punch may be any suitable shape. The housing of the punch assembly may be cylindrical, although the housing may be any other suitable shape to correspond to the shape of the pin.

According to this aspect of the invention, when the pin is in the first position, the protruding element of the pin extends beyond one end of the housing and the opposite end of the pin is flush with the housing. When the pin is in the second position, the protruding element of the pin is flush with one end of the housing and the opposite end of the pin protrudes from the housing.

The means for applying pressure to the punch may comprise a roll. The roll can contact the protruding element of the pin in action and can apply pressure to cause movement of the pin within the housing and into the powdered material to create an imprint in the powdered material. The distance moved by the pin is defined by the height of the protruding element of the pin. Pressure can be applied on the protruding element of the pin by the roll until the roll contacts the housing when the protruding element of the pin has been depressed until it is level with the top of the housing.

The protruding element of the pin may comprise a raised portion located on the top surface of the pin. The height of the raised portion is equal to the depth of the powder imprint required. The raised portion may occupy a section of the top surface of the pin, or cover the full surface of the top of the pin.

The depth of the imprint created by movement of the pin into the powdered material is suitably equal to the depth of the tablet core of the compression coated tablet to be deposited in the imprint. The depth of the imprint formed within the bottom fill suitably is less than 1.5 mm and the height of the raised portion located at the top of the inside cylinder is therefore suitably less than 1.5 mm.

The imprint forms a "cup" within the powdered material suitable for receiving a pre-formed core. The sides of the "cup" may act as a guide to ensure that the core does not move after its deposition in the bottom fill.

The torsion means may comprise a spring. However, any suitable torsion means may be used in the invention.

Preferably the brake means may comprise a key, which protrudes horizontally from the pin and communicates with a recess in the housing of the punch assembly to act as a stop to define the extent of movement of the pin relative to the housing.

The means for applying pressure may be adapted to engage only the housing of the punch by having a groove which fits over the protruding element of the pin. The means for applying pressure may be a roll, or any other suitable means for applying pressure conventionally used in tableting presses. The groove can be equal to or wider than the width of the protruding element of the pin. The roll therefore does not apply any pressure to the pin via the protruding element, but only contacts the housing. The pin therefore remains in the second position, with the end of the pin flush with the end of the housing.

It is desirable that the pin punch cylinder may be easily dismantled for cleaning purposes.

According to a second aspect of the invention there is provided an apparatus for producing a compression coated tablet comprising, a punch assembly which comprises a housing and a pin which is movable within the housing, in which the housing is adapted to receive and engage with the pin, the pin having a protruding element at one end, adapted for engagement with a first means for applying pressure to the pin to move the pin relative to the housing from a first position to a second position, the pin being provided with a torsion means to return the pin to the first position upon removal of the means for applying pressure, and in which the punch has a brake means for retarding movement of the pin in the housing beyond the first position.

The apparatus may further comprise a means for applying pressure to the housing only. The means for applying pressure to the housing only may comprise a roll adapted by having a groove in its surface. The groove should preferably be deeper than the height of the protruding element of the pin. The width of the groove should be equal to or wider than the width of the protruding element of the pin and should take into account the curvature of the turntable in order to avoid any contact of the raised portion with the side of the groove. The groove can be positioned on the roll to fit over the protruding element of the pin and therefore does not apply any pressure to the pin, but only contacts the housing. The pin therefore remains in the second position.

The use of the invention on a dry coating tablet press therefore requires as its sole adjustment the modification of the roll that applies the final pressure to form the press coated tablets. If the press is equipped with a roll for pre-compression then this roll should also be modified.

Preferred features for the second aspect of the invention are as for the first mutatis mutandis.

Figure 2:
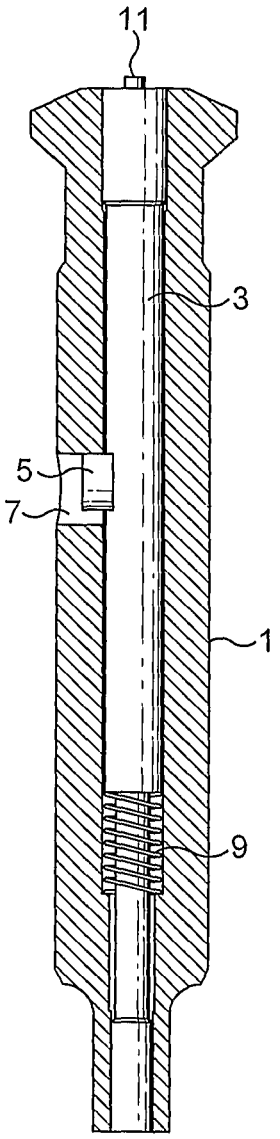
Figure 3:
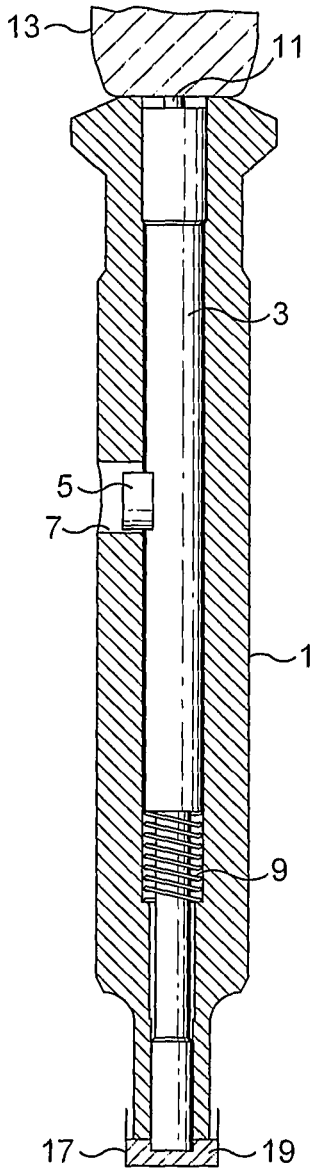
Figure 4:
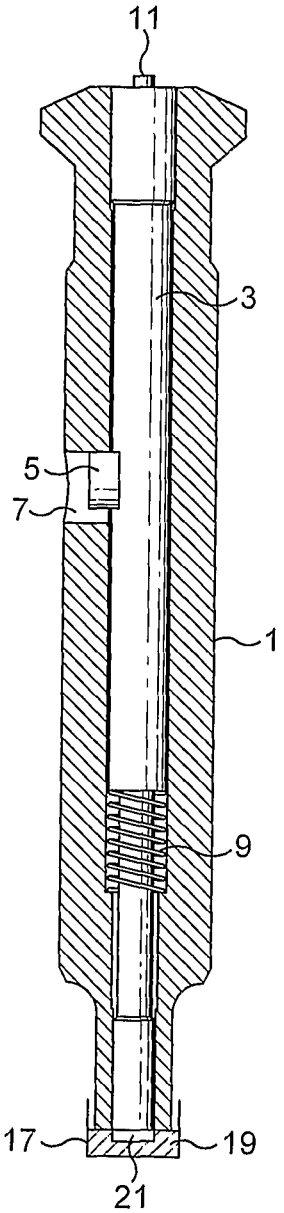
Figure 5:
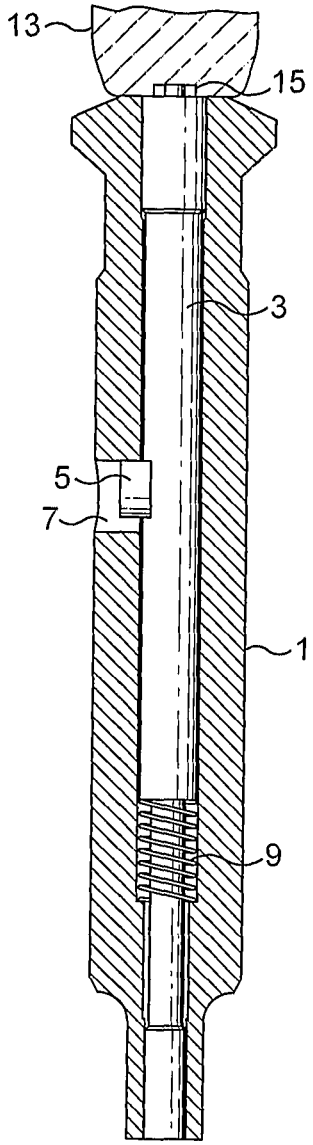

The invention will now be further described by way of reference to an Example and a description of a preferred embodiment of the invention in use which is present for the purposes of illustration only and is not to be construed as being limiting on the invention. In the Example and the description of the preferred embodiment, reference is made to a number of drawings in which:

FIG. 1—Shows a cross sectional view of the two parts of the pinch punch assembly FIG. 2—shows a cross sectional view of the pin punch assembly in its rest position FIG. 3—shows a cross sectional view of the pin punch assembly in its punching position FIG. 4—shows a cross sectional view of the pin punch assembly in its resting position after an imprint has been created in the powder FIG. 5—shows a cross sectional view of the grooved roll exerting pressure on the pin punch assembly.

Figure 6:
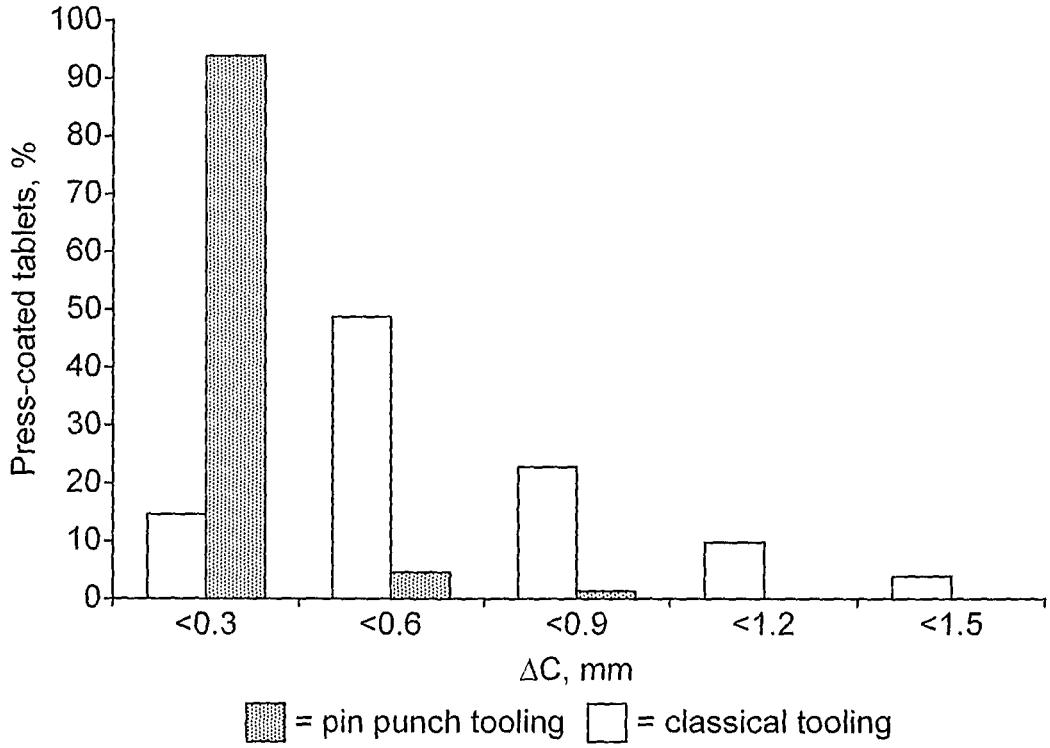

FIG. 6—shows a comparison of the centring of the core of coated compression tablets when using a classical tooling and the tooling of this invention.

In a preferred embodiment, the invention comprises a tablet press upper punch which is composed of two main parts as shown in FIG. 1. The first part is a hollow punch cylinder (1); the second part is a pin (3) which fits exactly inside the punch cylinder (1) and is moveable relative to the punch cylinder (1). The term cylinder is not limited to its geometrical meaning. The pin (3) has a key (5) which limits the movement of the pin (3) within the punch cylinder (1). The head of the key (5) protrudes from the pin (3) and fits into a recess (7) within the housing (1). The pin (3) also has a spring (9) which pushes back the pin (3) to its rest at the opposite end to the punching end where a small raised portion (11) is present.

When the pin punch is in its rest position (as shown in FIG. 2), the punching end of the pin (3) is flush with the end of the pin punch housing (1) and the raised portion (11) protrudes from the housing (1) at the opposite end of the pin (3). The pin (3) is prevented from retreating back within the housing (1) by the key (5) hitting the top side of the recess (7). The spring (9) is relaxed.

The pin punch assembly is then positioned so that it contacts the top of the bottom fill powder (19) in the die (17). A roll (13) is in place at the non punching end of the pin (3) and exerts pressure on the raised portion (11) on the pin (3). This pressure moves the pin (3) relative to the housing (1), compressing the spring (9) until the pin (3) protrudes from the housing (1) (FIG. 3). As the pin (3) moves, it punches an imprint (21) or a "cup" into the bottom fill. (FIG. 4) The size of the imprint (21) is directly dependent on the size of the pin (3), the depth of the imprint (21) is directly dependent on the height of the raised portion (11) located at the top of the pin (3).

The pin punch then leaves the first roll (13) and the pin (3) is returned to its original position by the action of the spring (9) and the key, which blocks the pin (3) in this position.

The core is then deposited in the imprint (21) and held in the right position by the edges of the imprint. The rest of the press coated tablet external powder is then added. The final pressure (and pre-pressure) is then applied. At this stage the pin (3) stays in its rest position and the system behaves as a conventional punch (FIG. 5). For the final compression step, the roll (13) has a groove (15) which fits over the raised portion (11) on the pin (3) so that no pressure is applied to the raised portion (11) and the pin (3) does not move relative to the housing (1).

A slight mark can be sometimes observed on the top surface of the press coated tablet revealing the use of a "two piece" punch for its manufacturing.

The apparatus of the invention could be completely dismantled in order to ease cleaning.

EXAMPLE

Preparation of Compression Coated Tablet and Comparison with Tablets Prepared Using a Conventional Punch The efficacy of the object of the invention was demonstrated by X-ray analysis (Sherlock software) of press coated tablets manufactured on the same tablet press using either conventional punches or punches of the invention.

A set of tablets was produced using the apparatus of the present invention. A die was filled with a powdered material and a pin punch assembly brought into contact with the powdered material. Pressure was applied to the raised portion on the top of the pin, resulting in the movement of the pin into the powder in the bottom fill to create an imprint in the powder. A tablet core was then transferred into the imprint in the powder and further powder added to the die to coat the tablet. The contents of the die were then compressed by the pin punch assembly, without movement of the pin within the housing, to create a compression coated tablet.

A set of tablets was prepared using a conventional punch, for comparison with those produced with the punch as described in the present invention.

A comparison of the obtained results (AC values) is shown in FIG. 6. The deviation from the theoretical centre AC is significantly limited when the punch of the invention is used. More than 90% of the tablets are produced with a deviation of the core position by less than 0.3 mm when the tooling of the present invention is used. In comparison, about 15% of the tablets were produced with a deviation from the core position by less than 0.3 mm when a conventional tooling was used.

The invention claimed is:

1. A method of producing a compression coated tablet having a precisely centered pre-formed core such that more than 90% of the tablets produced have a deviation of the core position by less than 0.3 mm from the theoretical center, the method comprising the steps of:

(a) filling a die with a first powdered material;

(b) contacting the powdered material in the die with a shaped punch assembly and applying pressure to the punch to create an imprint in the powdered material, the depth of the imprint being less than 1.5 mm, and the punch comprising a housing adapted to receive a pin which is movable within the housing, the pin having a protruding element at one end for engagement with a means for applying pressure to the pin and punch housing, said one end being opposite from the punching end, the pin being provided with a torsion means for engagement with the housing, in which the punch has a brake means for retarding movement of the pin in the housing; wherein the pin is held in a rest position by the torsion means to engage the protruding element of the pin with the means for applying pressure;

(c) applying pressure to the protruding element of the pin to cause movement of the pin within the housing into the powdered material to create the imprint in the powdered material followed by return of the pin to its rest position;

(d) depositing a pre-formed tablet core in the imprint created in the powdered material;

(e) introducing a second powdered material into the die; and (f) contacting the second powdered material with the punch and applying pressure to the punch to form a fully coated compression coated tablet, such that the pin is held in its rest position in the housing by the brake means and the means for applying pressure is adapted so as to engage with the housing of the punch only and not to engage with the pin.

2. The method according to claim 1, wherein the protruding element on the pin comprises a raised portion.

3. The method of claim 2, wherein the height of said raised portion determines the depth of the imprint in the powder.

4. The method of claim 1, wherein the means for applying pressure comprises a roll.

5. The method of claim 1, wherein the means for applying pressure is adaptable to engage with the housing of the punch cylinder only by having a groove which fits over the protruding element of the pin.

6. The method of claim 1, wherein the brake means comprise a key which protrudes from the pin and communicates with a recess located in the housing.

* * * * *